US008801374B1

(12) United States Patent
Lima

(10) Patent No.: US 8,801,374 B1
(45) Date of Patent: Aug. 12, 2014

(54) FAN TRAYS HAVING STATOR BLADES FOR IMPROVING AIR FLOW PERFORMANCE

(75) Inventor: David J. Lima, Los Altos, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 711 days.

(21) Appl. No.: 12/575,217

(22) Filed: Oct. 7, 2009

(51) Int. Cl.
*F04D 29/54* (2006.01)

(52) U.S. Cl.
USPC ..... 415/208.2; 415/211.2

(58) Field of Classification Search
USPC ..... 415/182.1, 183, 185, 189, 190, 208.1, 415/208.2, 60, 121.2; 416/227 R
See application file for complete search history.

(56) References Cited

U.S. PATENT DOCUMENTS

| | | | | |
|---|---|---|---|---|
| 4,971,143 | A | 11/1990 | Hogan | |
| 5,477,416 | A | 12/1995 | Schkrohowsky et al. | |
| 5,912,801 | A | 6/1999 | Roy et al. | |
| 5,955,955 | A * | 9/1999 | Corcoran et al. | 340/607 |
| 6,130,819 | A | 10/2000 | Lofland et al. | |
| 6,163,453 | A | 12/2000 | Hou et al. | |
| 6,163,454 | A | 12/2000 | Strickler | |
| 6,293,753 | B1 | 9/2001 | Pal et al. | |
| 6,332,758 | B1 | 12/2001 | Tang et al. | |
| 6,400,568 | B1 | 6/2002 | Kim et al. | |
| 6,449,150 | B1 | 9/2002 | Boone | |
| 6,508,621 | B1 | 1/2003 | Zeighami et al. | |
| 6,549,406 | B1 * | 4/2003 | Olesiewicz et al. | 361/695 |
| 6,565,334 | B1 | 5/2003 | Bradbury et al. | |
| 6,653,755 | B2 | 11/2003 | Machiroutu | |
| 6,749,398 | B2 * | 6/2004 | Lu et al. | 415/121.2 |
| 6,768,640 | B2 | 7/2004 | Doblar et al. | |
| 6,778,386 | B2 | 8/2004 | Garnett et al. | |
| 6,912,131 | B2 | 6/2005 | Kabat | |
| 6,989,988 | B2 | 1/2006 | Arbogast et al. | |
| 6,999,312 | B1 | 2/2006 | Garnett et al. | |
| 7,011,504 | B2 | 3/2006 | Seo et al. | |
| 7,074,123 | B2 | 7/2006 | Bettridge | |
| 7,079,388 | B2 | 7/2006 | Faneuf et al. | |
| 7,112,131 | B2 | 9/2006 | Rasmussen et al. | |
| 7,118,333 | B2 * | 10/2006 | Takemoto | 415/211.2 |
| 7,120,018 | B2 | 10/2006 | Shen et al. | |
| 7,154,748 | B2 | 12/2006 | Yamada | |
| 7,164,581 | B2 | 1/2007 | Carullo et al. | |
| 7,184,268 | B2 | 2/2007 | Espinoza-Ibarra et al. | |
| 7,209,351 | B2 | 4/2007 | Wei | |
| 7,241,110 | B2 | 7/2007 | Chang et al. | |
| 7,248,472 | B2 | 7/2007 | Vinson et al. | |

(Continued)

OTHER PUBLICATIONS

Servo, "Brushless DC Fans & Blowers, PUDC series 80×25 mm" Product Brochure, www.nidec-servo.com 2008/2009, 4 pages.

(Continued)

*Primary Examiner* — Nathaniel Wiehe
*Assistant Examiner* — Adam W Brown
(74) *Attorney, Agent, or Firm* — Cooley LLP

(57) ABSTRACT

Fan tray assemblies for cooling electronic devices in data processing units are described herein. In some embodiments, an apparatus includes a fan tray and a stator member. The fan tray is configured to be mounted within a data processing unit, and defines an opening. The fan tray is configured to be coupled to a fan such that the fan and the opening collectively define a portion of an air flow path. The stator member includes multiple stator blades. The stator member is separate from the fan and configured to be coupled to the fan tray such that the stator blades are within the air flow path.

12 Claims, 6 Drawing Sheets

(56) References Cited

U.S. PATENT DOCUMENTS

| | | | | |
|---|---|---|---|---|
| 7,256,995 | B2 | 8/2007 | Wrycraft et al. | |
| 7,329,091 | B2 | 2/2008 | Yan et al. | |
| 7,382,613 | B2 | 6/2008 | Vinson et al. | |
| 7,403,388 | B2 | 7/2008 | Chang | |
| 7,414,841 | B2 * | 8/2008 | Chen et al. | 361/697 |
| 7,420,806 | B1 | 9/2008 | Lima et al. | |
| 7,573,712 | B2 | 8/2009 | Wu et al. | |
| 7,654,309 | B2 | 2/2010 | Wu et al. | |
| 7,722,359 | B1 | 5/2010 | Frangioso et al. | |
| 7,804,684 | B1 | 9/2010 | Aybay et al. | |
| 7,813,120 | B2 | 10/2010 | Vinson et al. | |
| 7,885,066 | B2 | 2/2011 | Boyden et al. | |
| 7,916,472 | B1 | 3/2011 | Aybay et al. | |
| 7,990,706 | B2 | 8/2011 | Miyahara et al. | |
| 8,064,200 | B1 | 11/2011 | West et al. | |
| 8,120,912 | B2 | 2/2012 | Aybay et al. | |
| 8,125,779 | B2 | 2/2012 | Aybay et al. | |
| 8,238,094 | B1 | 8/2012 | Aybay et al. | |
| 8,279,601 | B2 | 10/2012 | Lima | |
| 2002/0018339 | A1 | 2/2002 | Uzuka et al. | |
| 2002/0126449 | A1 | 9/2002 | Casebolt | |
| 2002/0159883 | A1 * | 10/2002 | Simon et al. | 415/193 |
| 2004/0001311 | A1 | 1/2004 | Doblar et al. | |
| 2004/0130868 | A1 | 7/2004 | Schwartz et al. | |
| 2004/0264145 | A1 | 12/2004 | Miller et al. | |
| 2005/0207134 | A1 | 9/2005 | Belady et al. | |
| 2005/0281005 | A1 | 12/2005 | Carullo et al. | |
| 2006/0002084 | A1 | 1/2006 | Wei | |
| 2006/0126292 | A1 | 6/2006 | Pfahnl et al. | |
| 2006/0181846 | A1 | 8/2006 | Farnsworth et al. | |
| 2007/0058342 | A1 * | 3/2007 | Wu et al. | 361/695 |
| 2007/0081888 | A1 * | 4/2007 | Harrison | 415/47 |
| 2007/0223199 | A1 | 9/2007 | Fujiya et al. | |
| 2009/0296352 | A1 | 12/2009 | Lima | |
| 2010/0014248 | A1 | 1/2010 | Boyden et al. | |
| 2011/0182027 | A1 | 7/2011 | Lima | |

OTHER PUBLICATIONS

Ebmpapst, "3000 Series, Tubeaxial, 92×92×38 mm" Product Brochure, ebm-papst Inc., 2006, p. 134.

Delta, "FFB 60×60×38 MM Series" Product Brochure, [online], [retrieved on Jun. 15, 2009] Retrieved from the Internet: <URL: http://www.deltaww.com>, p. 55.

Programmable Logic DesignLine "How to effectively use fan trays in electronic systems"[online], [retrieved on Sep. 17, 2009] Retrieved from the Internet: <URL: http://www.pldesignline.com/219500379;jsessionid>, 5 pages.

Bob Schluter "Controlling the Temperature Inside Equipment Racks" © 2002-2004 Middle Atlantic Products, Inc., 48 pages.

Office Action mailed Dec. 22, 2011 for U.S. Appl. No. 12/695,509 (8 pages).

* cited by examiner

FAN TRAYS HAVING STATOR BLADES FOR IMPROVING AIR FLOW PERFORMANCE

BACKGROUND

This invention relates to apparatus and methods for cooling electronic devices, such as, for example, fan trays having stator blades for improving the air flow performance of the fans mounted thereto.

Data processing units, such as routers, switches, servers, storage devices, and/or components included within a core switch fabric of a data center, include electronic devices (e.g., amplifiers, signal processors, optical transceivers or the like) that can generate heat during their operation. To increase the processing speed and/or processing capacity, some known data processing units include high power electronic devices, more densely packaged electronic devices and/or the like. Accordingly, some known data processing units include forced air cooling systems to prevent overheating of the electronic devices contained therein.

Such known data processing units can include, for example, one or more fan trays upon which fans and/or blowers are mounted. The fan trays can be mounted within the chassis (or frame) of the data processing unit, and can produce a pressurized air flow within the channels, ducts and/or air flow pathways of the chassis to cool the electronic devices. Such fan trays further facilitate the mounting and electrical connections used to operate the fans and/or blowers. For example, some known fan trays can be configured to be contained within a specific "bay" defined within the chassis. Such fan trays can be referred to as "rack mounted" or "rack mountable" fan trays.

The selection of the air flow device (e.g., the fan or blower) for cooling known data processing units can be based on a variety of constraints, including, for example, the desired flow rate and pressure of the air flow, the power requirements, the cost of the device and/or the size of the device. In view of these criteria, some known data processing units include axial air flow devices, which produce an air flow that is substantially parallel to the axis of rotation of the rotor (e.g., the blade, propeller or impeller). Axial air flow devices generally produce a higher airflow, albeit at lower pressures, than a similarly-sized centrifugal blower. In particular, some known data processing units include one or more tubeaxial fans mounted to a fan tray.

Known axial fans used for cooling data processing units, however, can be susceptible to flow pulsations, high noise emissions and/or operation at low pressure or low efficiency. Accordingly, some data processing units include axial fans mounted in series, dual-rotor axial fans or the like. Such axial fan configurations, however, result in increased size and/or cost. Moreover, such axial fan configurations are often configured for a specific chassis design, and are not easily used in multiple different designs.

Thus, a need exists for improved apparatus and methods for improving the efficiency and flexibility of cooling systems for data processing units.

SUMMARY

Fan tray assemblies for cooling electronic devices in data processing units are described herein. In some embodiments, an apparatus includes a fan tray and a stator member. The fan tray is configured to be mounted within a data processing unit, and defines an opening. The fan tray is configured to be coupled to a fan such that the fan and the opening collectively define a portion of an air flow path. The stator member includes multiple stator blades. The stator member is separate from the fan and configured to be coupled to the fan tray such that the stator blades are within the air flow path.

DETAILED DESCRIPTION

Figure 1:
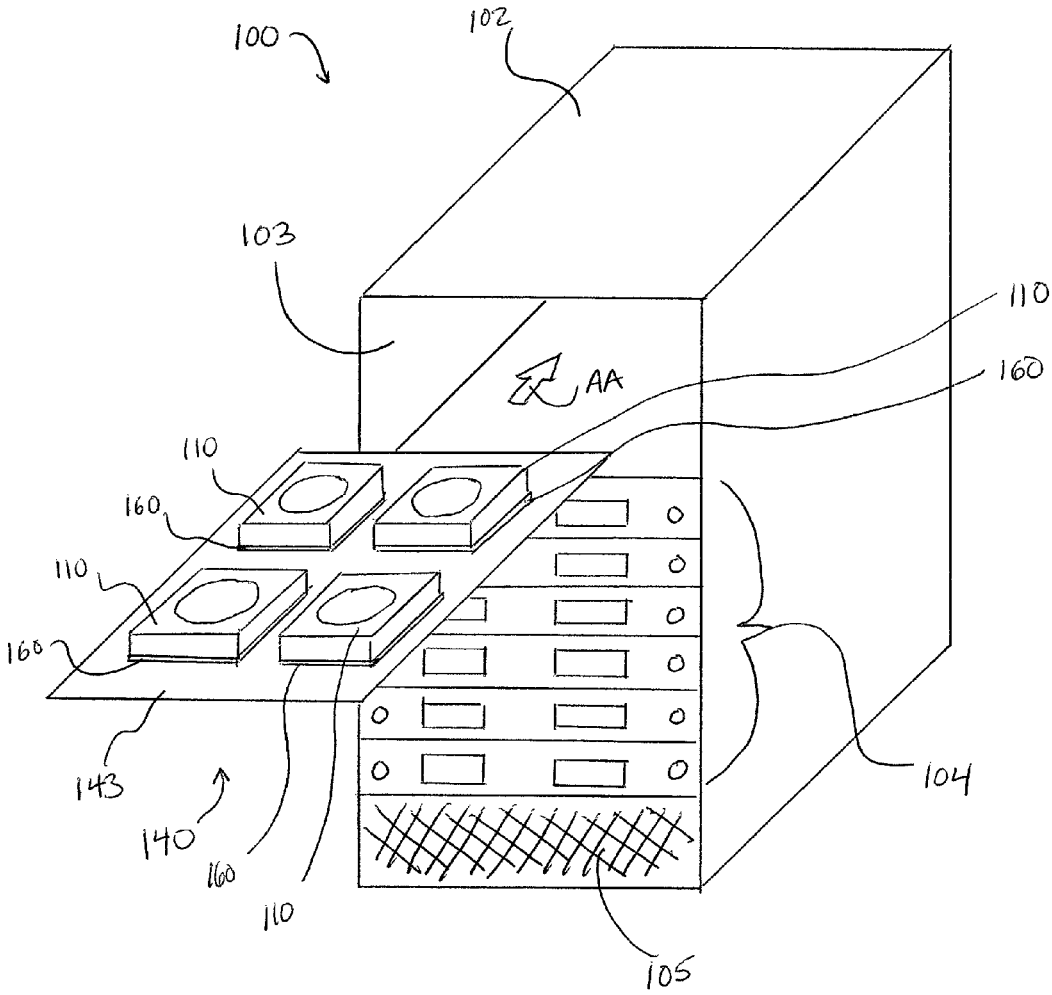
FIG. 1 is a perspective view of a data processing unit according to an embodiment.

Fan tray assemblies for cooling electronic devices in data processing units are described herein. In some embodiments, an apparatus includes a fan tray and a stator member. The fan tray is configured to be mounted within a data processing unit, and defines an opening. The fan tray is configured to be coupled to a fan such that the fan and the opening collectively define a portion of an air flow path. The stator member includes multiple stator blades. The stator member is separate from the fan and configured to be coupled to the fan tray such that the stator blades are within the air flow path. In some embodiments, for example, the stator member can be coupled to the fan tray such that the stator blades are substantially within the opening.

In some embodiments, an apparatus includes a fan tray and a stator member. The fan tray is configured to be mounted within a data processing unit and to be coupled to at least one fan. The stator member includes multiple stator blades configured to reduce a non-axial component of an air flow produced by the fan. The stator member is configured to be coupled to the fan tray independently from the fan being coupled to the fan tray.

In some embodiments, an apparatus includes a fan tray configured to be mounted within a data processing unit. The fan tray has a fan mounting portion and a stator portion. The fan mounting portion is configured to be coupled to a fan such that the fan and an opening defined by the fan mounting portion collectively define a portion of an air flow path. The stator portion includes a set of stator blades within the air flow path. The stator portion and the fan mounting portion are monolithically constructed.

As used herein the term "data processing unit" refers to, for example, any computer, electronic switch, switch fabric, portion of a switch fabric, router, host device, data storage device, line card or the like used to process, transmit and/or convey electrical and/or optical signals. A data processing unit can include, for example, a component included within an electronic communications network. In some embodiments, for example, a data processing unit can be a component included within or forming a portion of a core switch fabric of a data center. In other embodiments, a data processing unit can be an access switch located at an edge of a data center, or a host or peripheral device (e.g., a server) coupled to the access device. For example, an access switch can be located on top of a chassis containing several host devices.

As used herein the term "electronic device" refers to any component within a data processing unit that is configured to perform an electronic function associated with the data processing unit. An electronic device can include, for example, a switching device, a converter, a receiver, a transmitter, a signal conditioner, an amplifier or the like. In some embodiments, an electronic device can include an optical transceiver configured to convert electrical signals into optical signals and vice versa.

FIG. 1 is a perspective view of a data processing unit 100 according to an embodiment. The data processing unit 100 includes a chassis (or frame) 102, a set of rack units 104 and a fan tray assembly 140. The chassis 102 defines an internal region 103 within which the rack units 104, the fan tray assembly 140 and any additional components associated with the operation of the data processing unit 100 (e.g., power supplies, data transmission cables and the like) are disposed. In some embodiments, the chassis 102 can define one or more air flow paths (see e.g., flow path 106 shown in FIG. 2) through which air can flow to cool the electronic devices contained within the data processing unit 100. For example, as shown in FIG. 1, the front portion of the chassis 100 defines an air intake opening 105 and the rear portion of the chassis 102 defines an air outlet opening (not shown). Although the air intake is shown as being at the bottom front portion of the chassis 102, in other embodiments, the air intake and/or the air outlet can be in any suitable location.

The rack units 104 include the line cards and electronic devices that perform, at least in part, the functions of the data processing unit 100. For example, in some embodiments, the rack units 104 can include a printed circuit board (not shown in FIG. 1) populated with one or more electronic circuits (e.g., modules, chips, integrated circuit packages, etc.). In some embodiments, for example, the rack units 104 can include optical transceivers configured to convert optical signals to and from electrical signals. In some embodiments, the rack units 104 can be configured to transmit multiple signals associated with one or more data streams to and from other data processing units (not shown in FIG. 1) within a communications network.

The fan tray assembly 140 is configured to be mounted within the internal region 103 of the chassis 102 (as shown by the arrow AA in FIG. 1) and produce a pressurized air flow within the chassis 102 to cool the electronic devices therein. In some embodiments, the fan tray assembly 140 can be fixedly coupled within the chassis 102 via screws, bolts, welded joints or the like. In other embodiments, the fan tray assembly 140 can be removably coupled within the chassis 102, for example, to facilitate removal and/or repair of the fan tray assembly 140. In some embodiments, for example, the fan tray assembly 140 can be installed within the chassis 102 by sliding the fan tray assembly 140 along rails, guides and/or recesses (not shown in FIG. 1) within and/or defined by the chassis 102.

Figure 2:
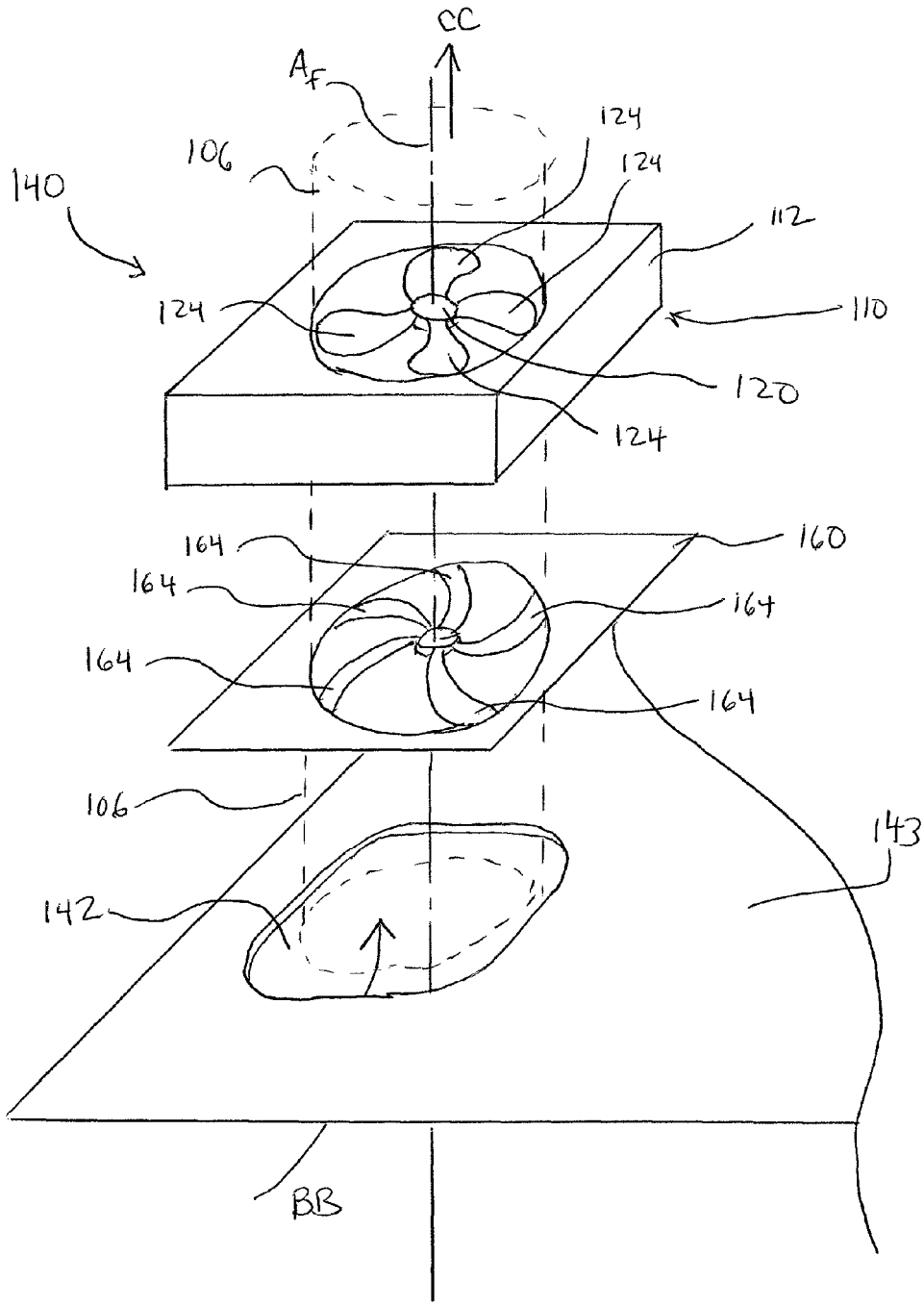
FIG. 2 an exploded view of the fan tray assembly of the data processing unit shown in FIG. 3.

The fan tray assembly 140 includes a fan tray 143, four fans 110 and four stator members 160. As shown in FIG. 2, which shows an exploded view of a portion of the fan tray assembly 140, each of the fans 110 includes a housing 112 and a rotor 120 that has a set of rotor blades 124. In operation, an electric motor (not shown) produces energy to rotate the rotor 120 about the fan axis $A_f$. The rotor blades 124 have an aerodynamic shape and/or orientation to produce a pressurized air flow when the rotor 120 is rotated about the fan axis $A_f$. More particularly, as shown in FIG. 2, the rotor blades 124 are configured to produce an air flow in a direction substantially parallel to the fan axis $A_f$, as shown by the arrow CC in FIG. 2. Accordingly, the fans 110 are said to be "axial fans." Although referred to as axial fans, as described below, the air flow produced by such fans typically includes a non-axial component (e.g., a rotational, swirl, tangential and/or circumferential component). The fans 110 can be any suitable type of axial fan, including propeller fans, tubeaxial fans and/or vaneaxial fans.

The fan tray 143 can be any suitable structural member for supporting the fans 110 and coupling the fan tray assembly 140 within the chassis 102. In particular, the fan tray 143 defines a set of openings 142 that correspond to each of the fans 110. Each fan 110 is coupled to the fan tray 143 such that the fan 110 and the opening 142 collectively define a portion of an air flow path 106 (shown in FIG. 2 in dashed lines) within the data processing unit 100. The data processing unit 100 and/or the chassis 102 is configured such that cooling air can flow within the air flow path 106, as shown by the arrows BB and CC in FIG. 2, to facilitate cooling of the electronic devices contained within the data processing unit 100. More particularly, the data processing unit 100 and/or the chassis 102 is configured such that cooling air can flow within the air flow path 106 to and/or from the electronic devices contained within the data processing unit 100. For example, in some embodiments, the inlet air can be conveyed within the air flow path 106 across the surface of one or more line cards within one of the rack units 104 to cool the electronic devices coupled to the line card. The air flow path 106 can also be defined, at least in part, by a portion of the chassis 102 or other structures (e.g., duct structures, tubes or the like, not shown in FIGS. 1 and 2) contained within or coupled to the chassis 103.

The stator member 160 includes a set of stator blades 164 and is disposed between the fan 110 and the fan tray 143. As shown in FIG. 2, the stator member 160 is coupled to the fan tray 143 such that the stator blades 164 are within the flow path 106. In this manner, the stator blades 164, can influence the characteristics and/or properties (e.g., the speed and/or direction) of the air flow within the air flow path 106.

Figure 3:
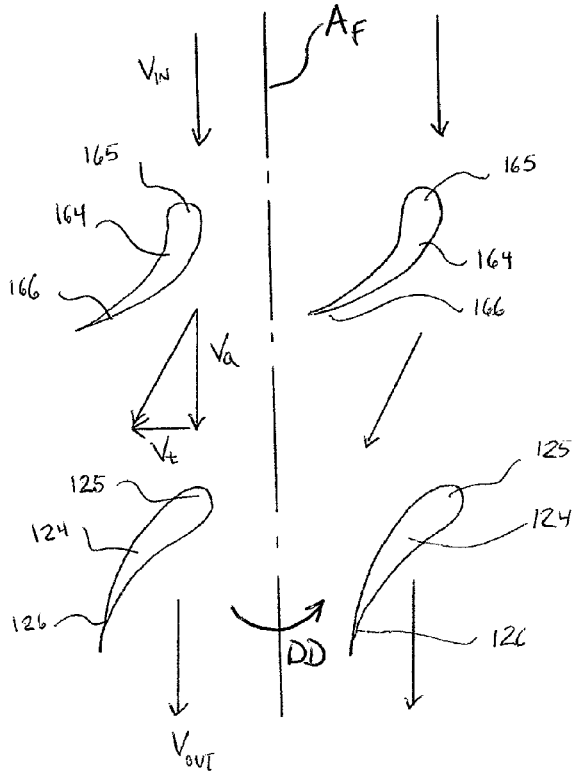
FIG. 3 is a two-dimensional schematic illustration of a portion of the rotor and a portion of the stator member shown in FIGS. 1 and 2.

In some embodiments, for example, the stator blades 164 and the rotor blades 124 are configured to cooperatively produce a substantially axial air flow (i.e., an air flow that is substantially parallel to the fan axis $A_f$) within the flow path 106. FIG. 3 shows a two-dimensional schematic illustration of two rotor blades 124 and two stator blades 164. The rotor blades 124 rotate relative to the stator blades 164 about the fan axis $A_f$, as shown by the arrow DD in FIG. 3. The stator blades 164 are configured to correspond to and/or cooperate with the rotor blades 124 to produce an air flow (shown by the arrow $V_{out}$) that is substantially parallel to the fan axis $A_f$. More particularly, as shown in FIG. 2, the stator blades 164 are disposed on the inlet side of the fan 110. Accordingly, as shown schematically in FIG. 3, the inlet air (shown by the arrow $V_{in}$) will first pass across the stator blades 164 before being acted upon by the rotor blades 124. The stator blades 164 are aerodynamically shaped such that when the inlet air $V_{in}$ flows across the stator blades 164 from the leading edge 165 to the trailing edge 166, the shape of the stator blades 164 redirects the air flow to produce an axial velocity component (shown by the arrow $V_a$) and a tangential velocity component (shown by the arrow $V_t$). The relative magnitudes of the axial velocity component and the tangential velocity component, which result from the shape and/or orientation of the stator blades 164, are such that when the air flows across the rotor blades 124 from the leading edge 125 to the trailing edge 126, the rotor blades 124 act upon the air to produce a substantially axial air flow (shown by the arrow $V_{out}$). In this manner, the stator blades 164 can compensate for, eliminate and/or reduce a portion of the non-axial component of the air flow that would otherwise be produced by the fan 110. Although FIG. 3 is a two-dimensional schematic illustration showing the non-axial velocity component as a tangential velocity component, the stator blades 164 can be configured to compensate for, eliminate and/or reduce a portion of any non-axial velocity component of the air flow that would otherwise be produced by the fan 110, including, for example, a circumferential velocity component and/or a rotational (or swirl) velocity component.

Figure 4:
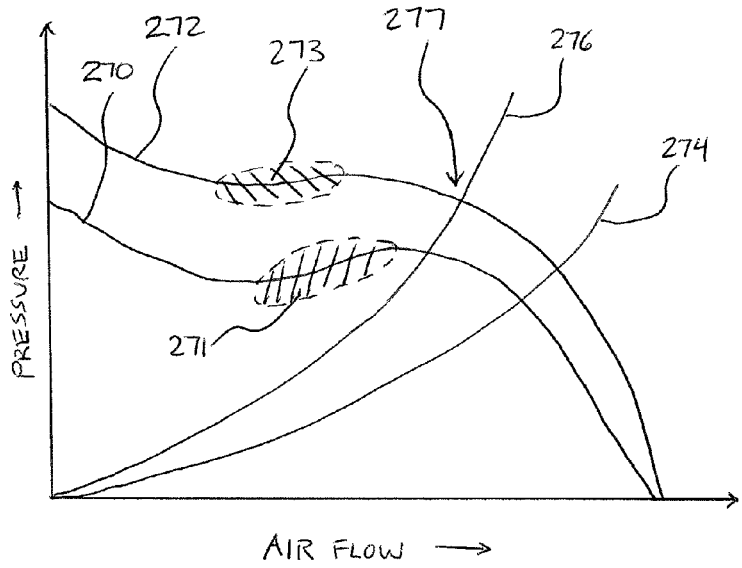
FIG. 4 is a plot showing a fan performance curve for a fan within the fan tray assembly shown in FIGS. 1 and 2.

By eliminating and/or reducing a portion of the non-axial component of the air flow that would otherwise be produced by the fan 110, the stator blades 164 can improve the performance of the fan 110. In this manner, the stator blades 164 can, at least in part, tailor the air flow characteristics for the data processing unit 100. Similarly stated, the stator blades 164 can improve the performance of the fan 110 to accommodate the system pressure drop, cost, space and/or power constraints of the data processing unit 100. For example, FIG. 4 shows a plot of a fan performance curve (identified as curve 270) for the fan 110 operating without a stator member and a fan performance curve (identified as curve 272) for the fan 110 operating with the stator member 160. The plot shown in FIG. 4 is for illustrative purposes only, and is not based on actual test results.

As illustrated by the fan performance curves 270, 272, the pressure produced by the fan (plotted on the Y-axis) generally increases as the air flow produced by the fan (plotted on the X-axis) decreases. Similarly stated, as the fan produces a higher pressure (e.g., to overcome restrictions and/or frictional losses within the air flow path 106), the air flow rate produced by the fan will generally decrease. As with most axial fans, however, during operation of the fan a region of instability exists beyond which the rotor blades 124 stall. The regions of instability are shown as the shaded region 271 on performance curve 270 and shaded region 273 on performance curve 272. In the regions 271 and 273 of the fan performance curve the design of the rotor blades 124 is such that, under certain operating conditions, the pressure produced by the fan decreases with decreasing air flow. Operating the fan within the region of instability can result in pulsating flow, high noise levels, lower efficiency and/or higher power consumption. Accordingly, it is generally desirable to operate the fan at air flow levels greater than those that would cause the fan to operate in the region. Said another way, referring the plot in FIG. 4, it is desirable to operate the fan at a point along the fan performance curve that is to the right of the region of instability.

The plot in FIG. 4 also includes two different system performance curves that characterize the air flow performance of a data processing unit, such as the data processing unit 100. The system performance curves, which are identified as system curve 274 and system curve 276, show the amount of back pressure produced by the air flow paths (e.g., air flow path 106) defined by two different data processing units as a function of the air flow through the air flow paths. Said another way, the system performance curves 274, 276 show the pressure that produces a given air flow through each data processing unit. The intersection of the system curve and the fan performance curve defines one point at which the fan will operate. Thus, a fan characterized by the fan performance curve 272 operating within a data processing unit characterized by system curve 276 will operate at the point along the fan performance curve labeled as point 277. The system curves 274, 276 shown in the plot of FIG. 4 are for illustrative purposes only, and are not based on actual test results.

The back pressure produced by the data processing unit and/or the air flow paths therein can be influenced by, among other things, the size (or flow area) of the air flow paths, the tortuosity of the air flow paths (i.e., the number and "sharpness" of the turns with the air flow paths) and/or the surface roughness of the components that define the air flow paths. Thus, system curve 274 can represent the air flow performance for a first data processing unit having larger and less tortuous air flow paths than that for a second data processing unit, which is represented by system curve 276. Because more pressure is used to produce a given air flow through the second data processing unit, the fan will be operating closer to the region of instability. As shown in FIG. 4, by including the stator member 160 within the fan tray assembly 140, the performance of the fan 110 can be improved (as indicated by the fan performance curve 272) to reduce the likelihood that the fan will operate within the region of instability 273.

As shown in FIG. 2, the stator member 160 is separate from the fan 110 (e.g., the stator member 160 is a separate component from the fan 110). Similarly stated, the stator member 160 is disposed outside of and/or is not a part of the housing 112 of the fan 110. Accordingly, in some embodiments, the stator member 160 can be coupled to the fan tray 143 independently from the fan 110 being coupled to the fan tray 143. More particularly, in some embodiments, the stator member 160 can be coupled to the fan tray 143 via a different coupling arrangement than that used to couple the fan 110 to the fan tray 143 and/or at a different time from when the fan 110 is coupled to the fan tray 143.

This arrangement can allow the stator member 160 to be pre-selected, adjusted and/or optimized to produce the desired flow characteristics for a particular fan 110 within a particular air flow path 106 and/or data processing unit 100. For example, in some embodiments, a first data processing unit can include fewer rack units 104 than a second data processing unit, which can result in the first data processing unit having a less restrictive air flow path than the second data processing unit. Referring to the plot in FIG. 4, the first data processing unit can be characterized by a system curve similar to system curve 274 and the second data processing unit can be characterized by a system curve similar to system curve 276. In such an embodiment, each of the data processing units can include a fan tray assembly having the same fan 110. Because the stator member 160 is separate from the fan 110, however, the fan tray assembly for the first data processing unit can include a stator member having a first aerodynamic design, and the fan tray assembly for the second data processing unit can include a stator member having a second aerodynamic design, different from the first. In this manner, the air flow performance for data processing units having different internal configurations can be tailored, adjusted and/or optimized without changing the fan 110 and/or fan tray 143. Moreover, the air flow performance for data processing units can be tailored, adjusted and/or optimized without impacting the space constraints within the data processing unit (i.e., without using larger fans, such as dual rotor fans or the like).

As another example, although the inlet air flow $V_{in}$ shown in FIG. 3 is shown as a substantially axial inlet flow, in other embodiments, a data processing unit and/or an air flow path therein can be configured such that the inlet air flow includes a tangential velocity component. In such embodiments, the shape and/or orientation of the stator blades can be different from the shape and/or orientation of the stator blades configured to redirect a substantially axial inlet air flow. Thus, the separate arrangement of the stator member 160 and the fan 110, as shown and described above, allows for the air flow performance to be tailored, adjusted and/or optimized to account for different inlet air flow characteristics.

Figure 5:
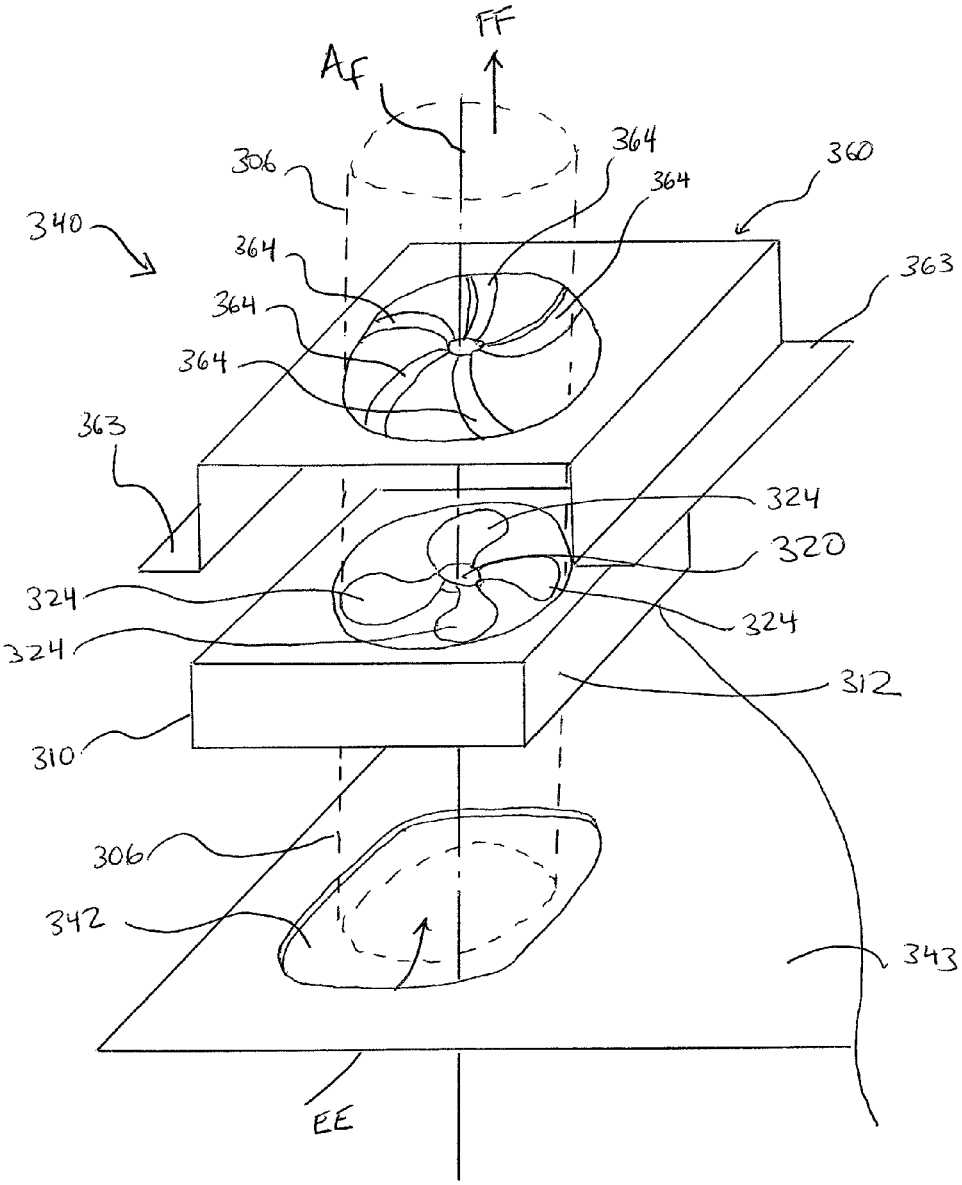
FIG. 5 is an exploded view of a fan tray assembly according to an embodiment.

Although the stator member 160 is shown as being on the intake side of the fan 110 (i.e., the inlet air first flows across the stator blades 164), in other embodiments, a fan tray assembly can include a stator member on the outlet side of a fan. For example, FIG. 5 shows an exploded view of a portion of a fan tray assembly 340, according to an embodiment, that can be disposed within a data processing unit (not shown in FIG. 5) as described above. The fan tray assembly 340 includes a fan tray 343, a fan 310 and a stator member 360. The fan 310 includes a housing 312 and a rotor 320 that has a set of rotor blades 324.

In operation, an electric motor (not shown) produces energy to rotate the rotor 320 about the fan axis $A_f$. The rotor blades 324 are aerodynamically designed to produce a pressurized air flow when the rotor 320 is rotated about the fan axis $A_f$. More particularly, as shown in FIG. 2, the rotor blades 324 are configured to produce an air flow in a direction substantially parallel to the fan axis $A_f$, as shown by the arrow FF in FIG. 5. Accordingly, the fan 310 is said to be an "axial fan." Although referred to as an axial fan, the air flow produced by the fan 310 can include a non-axial component (e.g., a rotational, swirl, tangential and/or circumferential component). The fan 310 can be similar to any of the fans shown and described herein.

The fan tray 343 can be any suitable structural member for supporting the fan 310 and coupling the fan tray assembly 340 within a data processing unit. In particular, the fan tray 343 defines an opening 342 corresponding to the fan 310. The fan 310 is coupled to the fan tray 343 such that the fan 310 and the opening 342 collectively define a portion of an air flow path 306 (shown in FIG. 5 in dashed lines) within the data processing unit. As described above, the data processing unit is configured such that cooling air can flow within the air flow path 306, as shown by the arrows EE and FF in FIG. 5, to facilitate cooling of the electronic devices contained within the data processing unit.

The stator member 360 includes a set of stator blades 364 and is coupled to the fan tray 343 such that the fan 310 is disposed between the fan tray 343 and the stator member 360. The stator member 360 includes two mounting portions 363 to facilitate coupling the stator member 360 to the fan tray 343. The mounting portions can include any suitable features for coupling the stator member 360 to the fan tray 343, such as, for example, clips, bolt holes, adhesive or the like.

As shown in FIG. 5, the stator member 360 is coupled to the fan tray 343 such that the stator blades 364 are within the flow path 306. More particularly, the stator blades 364 are within the flow path 306 downstream of the rotor blades 324. In this manner, the stator blades 364, can influence the characteristics and/or properties (e.g., the speed and/or direction) of the air flow within the air flow path 306. In some embodiments, for example, the stator blades 364 are configured to redirect a non-axial velocity component of an air flow produced by the fan 310. In this manner, the stator blades 364 and the rotor blades 324 are configured to cooperatively produce a substantially axial air flow (i.e., an air flow that is substantially parallel to the fan axis $A_f$) within the flow path 306. Similarly stated, the stator blades 364 redirect the inlet air flow ($V_{in}$) such that the resulting outlet flow ($V_{out}$) has a greater axial velocity component than would otherwise exist in the absence of the stator blades 364.

Figure 6:
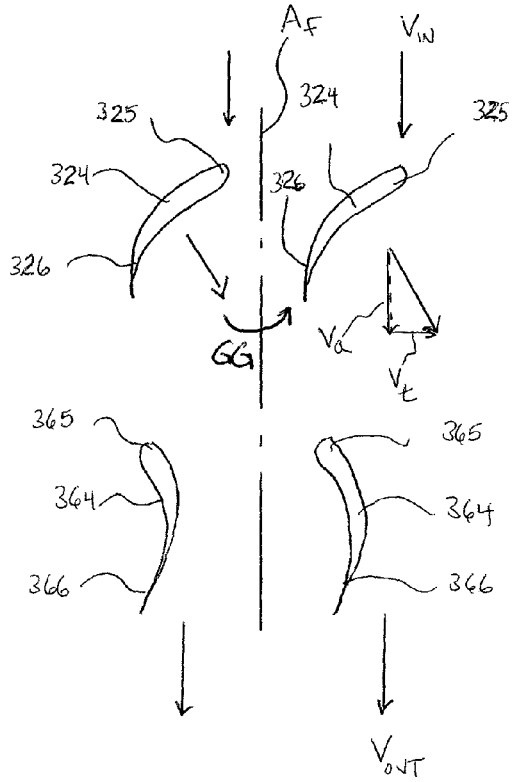
FIG. 6 is a two-dimensional schematic illustration of a portion of the rotor and a portion of the stator member from the fan tray assembly shown in FIG. 5.

FIG. 6 shows a two-dimensional schematic illustration of two rotor blades 324 and two stator blades 364. The rotor blades 324 rotate relative to the stator blades 364 about the fan axis $A_f$, as shown by the arrow GG in FIG. 6. The stator blades 364 are configured to correspond to and/or cooperate with the rotor blades 324 to produce an air flow (shown by the arrow $V_{out}$) that is substantially parallel to the fan axis $A_f$. More particularly, as shown in schematically in FIG. 6, the inlet air (shown by the arrow $V_{in}$) will first pass across and/or be acted upon by the rotating rotor blades 324. When the air flows across the rotor blades 324 from the leading edge 325 to the trailing edge 326, the rotor blades 324 act upon the inlet air to produce an axial velocity component (shown by the arrow $V_a$) and a tangential velocity component (shown by the arrow $V_t$). The relative magnitudes of the axial velocity component and the tangential velocity component, which result from the shape and/or orientation of the rotor blades 324, are such that when the air subsequently flows across the stator blades 364 from the leading edge 365 to the trailing edge 366, the stator blades 364 act upon the air to produce a substantially axial air flow (shown by the arrow $V_{out}$). In this manner, the stator blades 364 can compensate for, eliminate and/or reduce a portion of the non-axial component of the air flow that would otherwise be produced by the fan 310.

Figure 7:
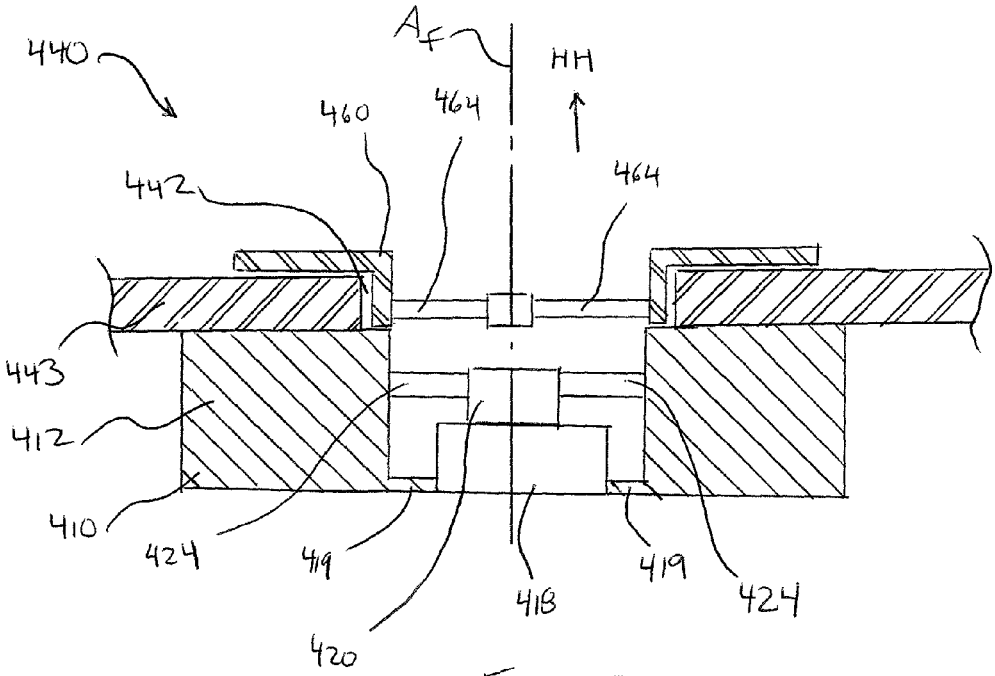
FIG. 7 is a cross-sectional view of a portion of a fan tray assembly according to an embodiment.

In some embodiments, a stator member can be coupled to a fan tray such that the stator blades are disposed substantially within an opening defined by the fan tray. In this manner, the stator member can be coupled to the fan tray without significantly increasing the overall size and/or profile of the fan tray assembly. For example, FIG. 7 show a cross-sectional side view of a portion of a fan tray assembly 440 according to an embodiment. The fan tray assembly 440 can be similar to any of the fan tray assemblies described herein, and can be disposed within a data processing unit (not shown in FIG. 7) as described above. The fan tray assembly 440 includes a fan tray 443, a fan 410 and a stator member 460.

The fan 410 includes a housing 412, a rotor 420 and a motor 418 that is supported by struts 419. The rotor 420 has a set of rotor blades 424, and is configured to rotate about the fan axis $A_f$ to produce a pressurized air flow. More particularly, the rotor blades 424 are configured to produce an air flow in a direction substantially parallel to the fan axis $A_f$, as shown by the arrow HH in FIG. 7.

The fan tray 443 can be any suitable structural member for supporting the fan and coupling the fan tray assembly 440 within a data processing unit. The fan tray 443 defines an opening 442. The fan 410 is coupled to the fan tray 443 such that the fan 410 and the opening 442 collectively define a portion of an air flow path, similar to the air paths shown and described above. In this manner, cooling air can flow within the air flow path, as shown by the arrow HH, to facilitate cooling of the electronic devices contained within the data processing unit.

The stator member 460 includes a set of stator blades 464 and is coupled to the fan tray 443 such that the stator blades 464 are substantially within the opening 442. Similarly stated, the stator blades 464 are disposed within the opening 442 such that the stator blades 464 are substantially flush with or are recessed from a surface of the fan tray 443. Thus, the stator blades 464 are within the flow path such that the stator blades 464 and the rotor blades 424 can cooperatively produce a substantially axial air flow, as described above. Moreover, by having the stator blades 464 substantially within the opening 442, the clearance between the stator blades 464 and the rotor blades 424 can be reduced. This arrangement also allows for the improved fan performance via the stator blades 464 without significantly increasing the overall size of the fan tray assembly 440.

Although the stator members have been shown and described herein as being within and/or defining, at least in part, a substantially cylindrical air flow path, in other embodiments, a stator member can define a portion of an air flow path having any suitable shape. For example, in some embodiments, a stator member can define a portion of an air flow path having a substantially rectangular shape. In this manner, the shape of the air flow path can correspond to a shape of a line card or other electronic device within a rack unit (e.g., rack unit 104) and/or a data processing unit (e.g., data processing unit 100). In other embodiments, a stator member can define a portion of an air flow path that transitions from a substantially circular cross-sectional shape to a substantially rectangular cross-sectional shape. For example, FIG. 8 is a perspective view of a stator member 560 according to an embodiment.

The stator member 560 can be coupled to and/or included within any of the fan tray assemblies shown and described herein. The stator member 560 includes a housing 561 defining a flow path 562 therein, and having an inlet portion 567 and an outlet portion 568. The inlet portion 567 includes a set of stator blades 564 that are disposed within the flow path 562. In this manner, air can flow across the stator blades 564 (e.g., after being acted upon by a fan rotor) and into the flow path 562, as shown by the arrow II in FIG. 8.

Figure 8:
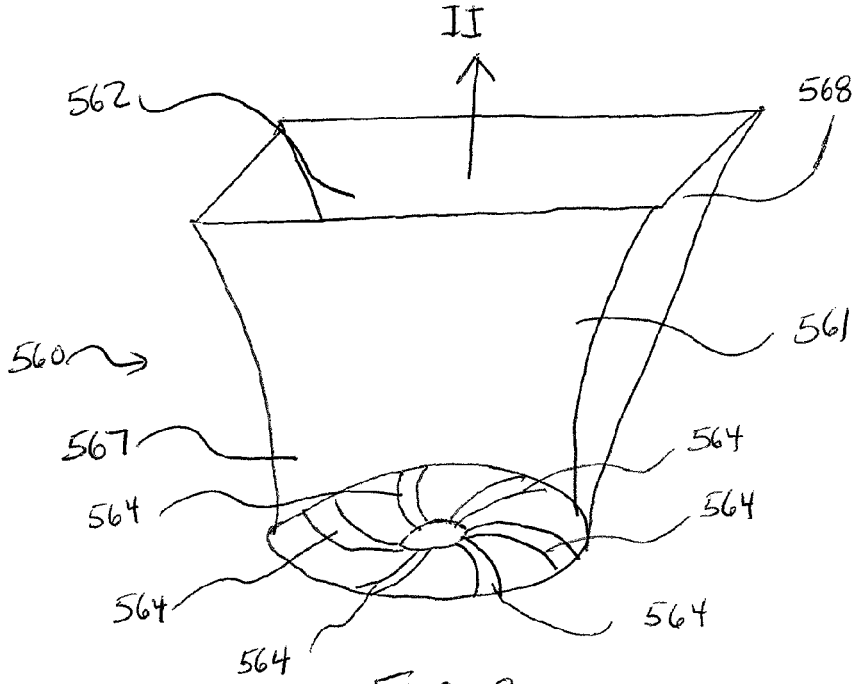
FIG. 8 is an exploded view of a stator member according to an embodiment.

As shown in FIG. 8, the inlet portion 567 of the housing 561 defines a substantially circular cross-sectional shape. The outlet portion 568 of the housing 561 defines a substantially rectangular cross-sectional shape. In this manner, the air flow within the flow path can be redirected by the stator blades 564, as described above, and can also be transitioned into an air flow path having a rectangular cross-sectional shape.

Although the fan tray assemblies, such as, for example, the fan tray assembly 140 are shown and described herein as including a fan tray (e.g., fan tray 143) and a separately constructed stator member (e.g., stator member 160), in other embodiments, the fan tray and the stator member can be monolithically constructed. Similarly stated, in some embodiments, the fan tray (i.e., the structural member to which one or more fans is mounted) and the stator blades can be constructed in the same operation or set of operations. For example, in some embodiments, the fan tray can be cast to include one or more sets of stator blades as shown above. In other embodiments, the fan tray can be molded (e.g., injection molded) to include one or more sets of stator blades as shown above.

Figure 9:
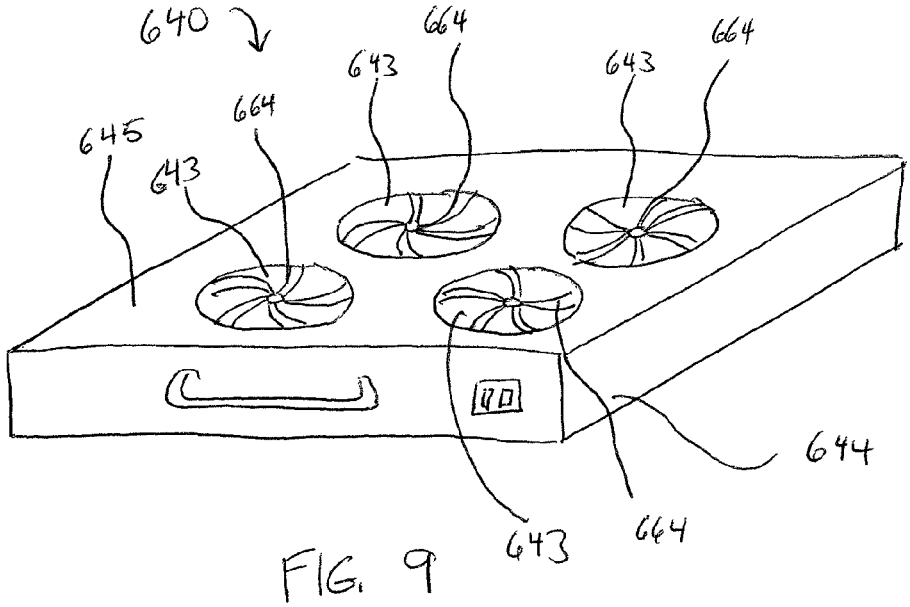
FIG. 9 is a perspective view of a fan tray assembly according to an embodiment.

Although the fan trays (e.g., fan tray 143) are shown and described herein as having a generally planar shape, in other embodiments, a fan tray assembly can be a rack unit having one or more fan trays having a non-planar and/or three-dimensional shape. For example, FIG. 9 shows a fan tray assembly 640 according to an embodiment. The fan tray assembly 640 is a rack-mountable fan tray assembly, and can be mounted within a data processing unit, as described above. In some embodiments, the fan tray assembly 640 can conform to industry standards for rack-mountable fan tray assemblies and/or electronic devices. In some embodiments, for example, the fan tray assembly 640 can be a "hot pluggable" fan tray assembly.

The fan tray assembly 640 includes a base member 644 and a cover 645 that collectively define an interior region (not shown in FIG. 9), within which a set of fans and the associated electronics are disposed. The fans and associated electronics (e.g., power cables, connectors or the like) are not shown in FIG. 9. The cover 645 and the base member 644 each define a set of openings that correspond to the fans contained therein. Only the openings 643 defined by the cover 645 are shown in FIG. 9. In this manner, the fan tray assembly 640 defines, at least in part, one or more air flow paths.

The cover 645 is monolithically constructed to include a set of stator blades 664 within each of the openings 643. The stator blades 664 can have a similar function and/or design as any of the stator blades shown and described above. Although not shown in FIG. 9, in some embodiments the base member 644 can be monolithically constructed to include a second set of stator blades within the openings defined by the base member 644. In such embodiments, the fan tray assembly 640 includes stator blades at both the fan inlet and the fan outlet.

In some embodiments, a method of assembling a fan tray assembly includes coupling a stator member to a fan tray member independently from a fan being coupled to the fan tray member. The stator member can be any of the stator members shown and described herein, such as, for example, the stator member 160. In some embodiments, the method can further include coupling the fan to the stator member and/or the fan tray. The stator member can be coupled adjacent either the inlet portion of the fan or the outlet portion of the fan.

In some embodiments, a method can include monolithically constructing a fan tray member to include a set of stator blades of the types shown and described above. In some embodiments, the method further includes coupling one or more fans to the monolithically constructed fan tray member.

While various embodiments have been described above, it should be understood that they have been presented by way of example only, and not limitation. Where methods and/or schematics described above indicate certain events and/or flow patterns occurring in certain order, the ordering of certain events and/or flow patterns may be modified. While the embodiments have been particularly shown and described, it will be understood that various changes in form and details may be made.

The fans shown and described herein can be any suitable type of device for producing a pressurized air flow. For example, in some embodiments, a fan can be any suitable tubeaxial fan produced by Delta Electronics, Inc., such as for example, the QFR 60×60×38 Series tubeaxial fan. In other embodiments, a fan can be any suitable tubeaxial fan produced by EBM-Papst, Inc., such as for example, the 3000 Series tubeaxial fan. In yet other embodiments, a fan can be any suitable tubeaxial fan produced by the Nidec Servo Corporation, such as for example, the PUDC series tubeaxial fan. Moreover, although the fans are shown and described herein as being primarily tubeaxial fans, in other embodiments, a fan can be any suitable type of device for producing a pressurized air flow. For example, in some embodiments, a fan tray assembly can include centrifugal fans (i.e., blowers) or a combination of both axial fans and centrifugal fans.

Although air is the cooling medium described herein (e.g., the flow paths are often referred to as "air" flow paths), in other embodiments, any suitable gas can be used as the cooling medium. For example, in some embodiments, the cooing medium can be nitrogen.

Although the stator members shown and described above include a specific number of stator blades (e.g., the stator member 160 is shown as having five stator blades 164), in other embodiments, a stator member can have any suitable number of stator blades. In some embodiments, for example, a stator member can have the same number of stator blades as a number of rotor blades in the corresponding fan. In other embodiments, a stator member can have a fewer number of stator blades than a number of rotor blades in the corresponding fan. In yet other embodiments, a stator member can have a higher number of stator blades than a number of rotor blades in the corresponding fan.

Although the fan tray assemblies are shown as having one stator member for each fan, in other embodiments, a fan tray assembly can have any number of stator members and any number of fans. In some embodiments, a fan tray assembly can have more fans than stator members. For example, in some embodiments, a fan tray assembly can have one stator member having multiple sets of stator blades within multiple flow paths and/or redirecting flow from several fans. In other embodiments, a fan tray assembly can have fewer fans than stator members. In yet other embodiments, a fan tray assembly can include a first stator member on the inlet side of a fan and a second stator member on the outlet side of the fan.

Although various embodiments have been described as having particular features and/or combinations of components, other embodiments are possible having a combination of any features and/or components from any of embodiments as discussed above. For example, in some embodiments, rack-mountable fan tray assembly similar to the assembly shown in FIG. 9 can include a separately constructed stator member similar to the stator member 160 shown and described in FIGS. 1-3.

What is claimed is:

1. An apparatus comprising:

a fan tray configured to be mounted within a data processing unit, the fan tray defining a through-hole, a first side of the fan tray configured to be coupled to a stator member including a plurality of stator blades such that the plurality of stator blades is disposed substantially between the first side of the fan tray and a second side of the fan tray; and a fan configured to be coupled to the second side of the fan tray such that the fan, the through-hole, and the stator member collectively define a portion of an air flow path.

2. The apparatus of claim 1, wherein the fan tray is configured to be coupled to the stator member independent from the fan being coupled to the fan tray.

3. The apparatus of claim 1, wherein the plurality of stator blades is configured to redirect a portion of at least one of a tangential velocity component or a circumferential velocity component of an air flow produced by the fan into an axial velocity component of the air flow.

4. The apparatus of claim 1, wherein the plurality of stator blades and a plurality of rotor blades of the fan are cooperatively configured to produce a substantially axial air flow.

5. The apparatus of claim 1, wherein the fan is configured to produce a first air flow when the fan is mounted within the data processing unit, and the stator member is configured to modify a system curve of the data processing unit such that the fan can produce a second air flow when the stator member is coupled to the fan tray, the second air flow greater is than the first air flow.

6. An apparatus comprising:

a fan configured to be coupled to a first side of a fan tray; and a stator member configured to be coupled to a second side of the fan tray, the stator member including a plurality of stator blades configured to be disposed within a through-hole of the fan tray such that the stator blades are substantially between the first side of the fan tray and the second side of the fan tray.

7. The apparatus of claim 6, wherein the fan and the stator member are each configured to be independently coupled to the fan tray.

8. The apparatus of claim 6, further comprising:

the fan tray, the fan tray configured to be mounted within a data processing unit.

9. The apparatus of claim 6, wherein the fan is directly coupled to the first side of the fan tray.

10. The apparatus of claim 6, wherein the stator member is directly coupled to the second side of the fan tray.

11. The apparatus of claim 6, wherein the fan is removeably coupled to the first side of the fan tray.

12. The apparatus of claim 6, wherein the stator member is configured to be removeably coupled to the second side of the fan tray.

* * * * *